US005508568A

United States Patent [19]

Mammen

[11] Patent Number: 5,508,568

[45] Date of Patent: Apr. 16, 1996

[54] RECEPTACLE SAFETY DEENERGIZER

[76] Inventor: Alex Mammen, 1006 Tomahawk Pl., Murfreesboro, Tenn. 37129

[21] Appl. No.: 240,438

[22] Filed: May 10, 1994

[51] Int. Cl.[6] ..... H01H 42/00

[52] U.S. Cl. ..... 307/117; 367/94; 367/197; 361/42; 361/170

[58] Field of Search ..... 307/117, 94, 197; 361/42, 170

[56] References Cited

U.S. PATENT DOCUMENTS

| | | | |
|---|---|---|---|
| D. 271,670 | 12/1983 | Takai et al. . | |
| 3,970,987 | 7/1976 | Kolm | 340/15 |
| 4,171,944 | 10/1979 | Hirschmann . | |
| 4,258,291 | 3/1981 | Scott et al. | 315/156 |
| 4,476,554 | 10/1984 | Smith et al. | 367/197 |
| 4,947,148 | 8/1990 | MacDonald . | |
| 4,973,881 | 11/1990 | Haraden . | |
| 4,991,145 | 2/1991 | Goldstein et al. . | |
| 5,012,223 | 4/1991 | Griebell et al. | 340/531 |
| 5,019,935 | 5/1991 | Nakamura . | |
| 5,162,777 | 11/1992 | Kolbatz . | |

*Primary Examiner*—William M. Shoop, Jr.
*Assistant Examiner*—Albert W. Paladin
*Attorney, Agent, or Firm*—Richard C. Litman

[57] ABSTRACT

A safety device for breaking power supplied to the plug of an appliance cord from a standard, preexisting electrical receptacle. The device plugs into the standard receptacle, and in turn accepts the plug of the appliance in an exposed corresponding receptacle. The device detects an audible alarm signal from a standard, preexisting smoke detector, and operates an automatic switch provided in the device. The automatic switch interrupts a power circuit which normally conducts power from the preexisting receptacle to the corresponding receptacle provided in the safety device. A control circuit operates the automatic switch responsive to detection of the audible alarm. An alarm condition indicator and manual reset are provided. The device is compact and unobtrusive, plugs manually into the preexisting receptacle, and requires no modification to the preexisting receptacle, smoke detector, or appliance in order to operate automatically. In an alternative embodiment, the device is intended for incorporation into the building wiring system, and forms a permanent component thereof.

16 Claims, 3 Drawing Sheets

RECEPTACLE SAFETY DEENERGIZER

BACKGROUND OF THE INVENTION

1. Field of the Invention

The present invention relates to a safety device for breaking power to a source of household electrical power. In alternative embodiments, the device plugs into a standard wall receptacle, or supplants a standard receptacle. Under normal conditions, the novel device passes power to power cords from appliances which are plugged into the safety device, and discontinues this power responsive to an alarm signal from a smoke detector.

2. Description of the Prior Art

In the event of fire, it is desirable to discontinue electrical power from certain electrical appliances operating in a building. In some cases, an appliance may be the source of an alarm signal generated by a smoke detector. For example, a cooking device, such as a fryer or oven which is unattended may emit smoke, which will then be sensed by a smoke detector.

In other cases, the appliance, which may operate innocuously under normal conditions, may exacerbate an incipient fire. A fan or the like, paint or solvent spraying equipment, air compressors, and the like which may be operated in a building susceptible to fire, are further examples of electrically operated equipment which may benefit from such protection.

U.S. Pat. No. 4,171,944, issued to Jack B. Hirschmann on Oct. 23, 1979, discloses a system for shutting off a powered appliance responsive to detection of smoke. In this invention, a smoke detector produces a signal which is employed to operate a relay controlling electrical power to the appliance, a furnace.

A device disposed in series within an electrical supply cord, having a plug for insertion into an electrical receptacle, is seen in U.S. Pat. No. 5,019,935, issued to Ikuro Nakamura on May 28, 1991. Detection of the alarm condition is accomplished by monitoring current flowing in the supply cord.

A shutoff arrangement for a specialized electric lamp, typically a high intensity discharge lamp, is disclosed in U.S. Pat. No. 4,973,881, issued to Thomas Haraden et al. on Nov. 27, 1990. Damage to an outer surrounding member causes a mechanical linkage to disconnect power to the lamp.

Sonic detectors for detecting an alarm condition by sound and generating a response are known. U.S. Pat. Nos. 4,991,145, issued to Steven G. Goldstein et al. on Feb. 5, 1991, and 5,162,777, issued to Klaus-Peter Kolbatz on Nov. 10, 1992, are representative. Both of these inventions employ a microphone for detecting sonic manifestation of an alarm condition.

None of the above inventions and patents, taken either singly or in combination, is seen to describe the instant invention as claimed.

SUMMARY OF THE INVENTION

The present invention is primarily concerned with breaking power to general purpose electrical receptacles responsive to detection of fire or smoke. A device is disclosed which, in its two principal embodiments, cooperates with standard receptacles, or supplants standard receptacles. The device responds to standard, preexisting smoke detectors emitting audible alarms. In the first embodiment, the device includes its own prongs, for insertion into the standard receptacle. In turn, the device has a corresponding receptacle, and internal circuitry extending the power circuitry from the standard receptacle to the corresponding receptacle.

In the second embodiment, the device is combined with a wall receptacle. In this form, the device is provided when the building is first constructed.

The device is configured to maintain visual similarity to a standard receptacle, so that its purpose and operation are immediately apparent to an observer. It will be obvious to a user that the device be plugged into an electrical receptacle, and that the plugs of power cords of appliances are plugged into the receptacle of the novel device. The housing is of minimal volume and external complexity, so that it is unobtrusive with regard to its environment.

Inside the housing are circuitry for detecting the audible alarm signal of the smoke detector, and an automatic switch for discontinuing electrical power to the device receptacle. The device detects an acoustic alarm signal, and will generally discriminate so as to respond to predetermined acoustic characteristics.

Whether the device is plugged into an existing electrical receptacle, or is integral therewith, no further attention need be paid thereto. When a person desires to employ an electrical appliance, that appliance is connected to the receptacle of the device conventionally, and the device is automatically operable.

Likewise, no modification to or modified operation of the smoke detector is required.

Preferably, the device includes an indicator indicating when the device has tripped, or opened the power circuit. Also, the device maintains the tripped condition, and includes and a manual reset for resetting the device to active status, or restoring power.

Although automatic restoration of power is possible, it is preferred to require manual resetting. This serves notice to the user that an alarm condition existed, even if that condition has passed.

Accordingly, it is a principal object of the invention to provide a power disconnecting device which cooperates with a standard electrical receptacle.

An additional object of the invention is that the device be automatically responsive to an audible alarm signal of predetermined acoustic characteristics.

It is another object of the invention that the disconnecting device be manually plugged into a standard receptacle.

It is a further object of the invention to provide an external appearance similar to that of a standard electrical receptacle.

It is again an object of the invention to provide a combined standard receptacle and a power disconnecting device which responds to an audible alarm.

A still further object of the invention is to provide indication of the tripped condition.

An additional object of the invention is to maintain the tripped condition until the device is manually reset, and to provide for manually resetting the device to active status.

Still another object of the invention is to provide an external package of minimal obtrusive visual effect.

It is an object of the invention to provide improved elements and arrangements thereof in an apparatus for the purposes described which is inexpensive, dependable and fully effective in accomplishing its intended purposes.

These and other objects of the present invention will become readily apparent upon further review of the following specification and drawings.

BRIEF DESCRIPTION OF THE DRAWINGS

Similar reference characters denote corresponding features consistently throughout the attached drawings.

DETAILED DESCRIPTION OF THE PREFERRED EMBODIMENTS

Figure 1:
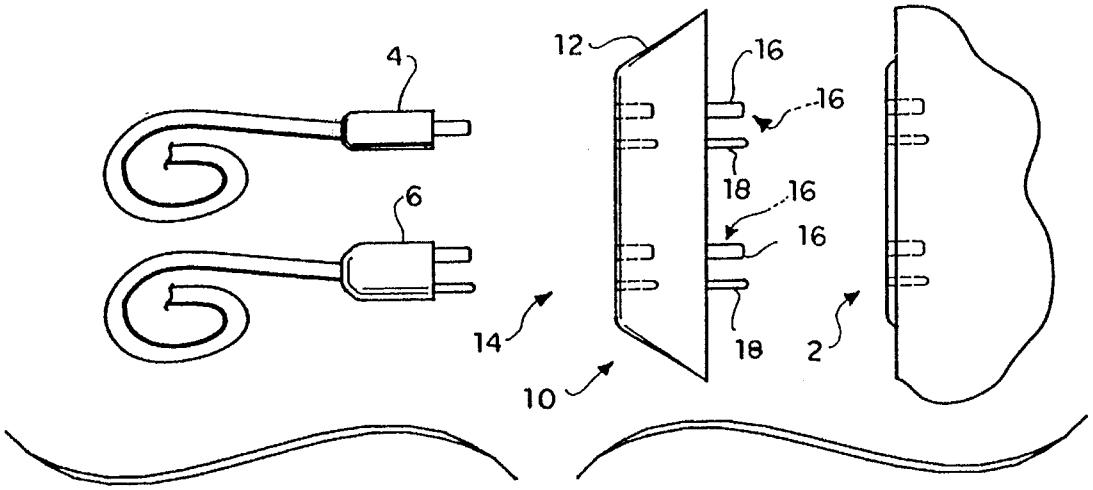
FIG. 1 is a side elevational, exploded, environmental view of the invention.

Turning now to FIG. 1 of the drawings, the invention is seen in relation to its environment, this being illustrated in exploded form. The novel safety device 10 is configured to be plugged into a standard, preexisting, wall mounted duplex electrical receptacle 2. Housing 12 of safety device 10 completely covers receptacle 2, so that a user will not be confused. Inside housing 12 is control circuitry 22 (see FIG. 2, discussed below) for detecting the audible alarm signal of a smoke detector and an automatic switch 26 (see FIG. 2) for disconnecting power to duplex receptacle 14. Safety device 10 in effect extends receptacle 2. Since the present invention provides a measure of safety by discontinuing power to receptacle 14, and to identify this receptacle with respect to preexisting receptacle 2, receptacle 14 will be referred to as "protected". Standard plugs 4,6 of appliances (not shown) are placed into receptacle 14 in the same manner as would occur with receptacle 2. Receptacle 14 is of configuration corresponding to that of receptacle 2, including two powered electrodes or prongs 16 and a ground electrode or prong 18, so that a user will use safety device 10 in the normal way, without being specially instructed. This holds true whether the appliance plug is of the two pronged type 4 or of the three pronged, grounded type 6.

Figure 2:
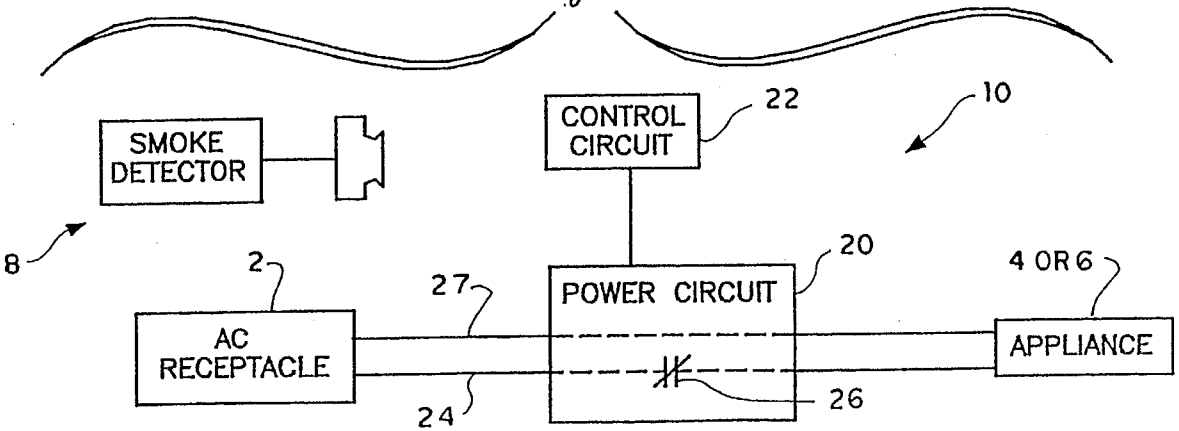
FIG. 2 is a block diagram illustrating the relationship of the control circuitry and power circuitry of the present invention with related environmental components.

The function of safety device 10 is better explained with reference to FIG. 2. In this diagram, the power conducting circuitry 20 of safety device 10 is shown separately from control circuitry 22.

Power circuitry 20 includes electrical conductors connectable to the power conductors of preexisting receptacle 2. The electrical conductors include protruding prongs 16,18 (see FIG. 1) cooperating with and attachable to preexisting receptacle 2, so that safety device 10 is installed by plugging the same into receptacle 2. This attachment both supports safety device 10, and extends power in series thereto.

Protected receptacle 14 (see FIG. 1) corresponds in configuration to preexisting receptacle 2. This signifies that the external appearance indicates similar function, having an identical pattern of apertures for receiving prongs of a plug 4 or 6. These apertures will be located at the same level and orientation, with respect to top or upright, as preexisting receptacle 2.

Power circuitry 20 includes a set of normally closed contacts 26 disposed in series with ungrounded power conductor 24. Grounded conductor 27 has continuity maintained for safety reasons.

The embodiment illustrated is typical of that employed to control a nominal 120 volt AC receptacle 2, as is most commonly encountered in residential and commercial receptacles. The partial power circuit extending from receptacle 2 to the plug 4 or 6 of an appliance is clearly indicated in this diagram.

Of course, the same principles apply to other voltages, such as 240 volt AC, single phase receptacles (not shown), wherein two ungrounded conductors would be simultaneously opened by two sets of normally closed contacts, and a third, uninterrupted grounded conductor would also be provided.

Control circuitry 22 detects the sound of a standard smoke detector alarm 8, and causes power circuitry 20 to break continuity responsive to such detection. Function of control circuitry 22 will now be discussed, with reference to FIG. 3. Microphone 28 acts as a transducer by producing an output voltage potential between conductors 30 and 32. This voltage is proportional to the sound level of an acoustic wave detected by microphone 28.

The output voltage is amplified in well known manner by a single stage audio amplifier, comprising resistors 34,36, 38,40,42; transistor 44; and capacitor 46. A smoothing circuit prevents oversensitivity to sounds which are of brief duration or which are intermittent. The smoothing circuit includes diode 48, capacitor 50, and resistor 52.

The smoothed output voltage is then conducted to a voltage comparator, which includes a voltage divider 54, comprising resistors 56,58, and an operational amplifier 60. Voltage divider 54 produces a threshold voltage which is a predetermined fraction or proportion of the power supply voltage, this threshold voltage being provided at one input of operational amplifier 60. At the other end of operational amplifier 60, the smoothed voltage output is provided. When the smoothed output voltage exceeds the predetermined threshold voltage, operational amplifier 60 energizes a coil 62 of a relay opening normally closed contacts 26.

Power for this control scheme is provided by any suitable power source 64. Power source 64 may be a DC power cell, a rectifier deriving power from the AC circuit being controlled, or still other devices.

Figure 4:
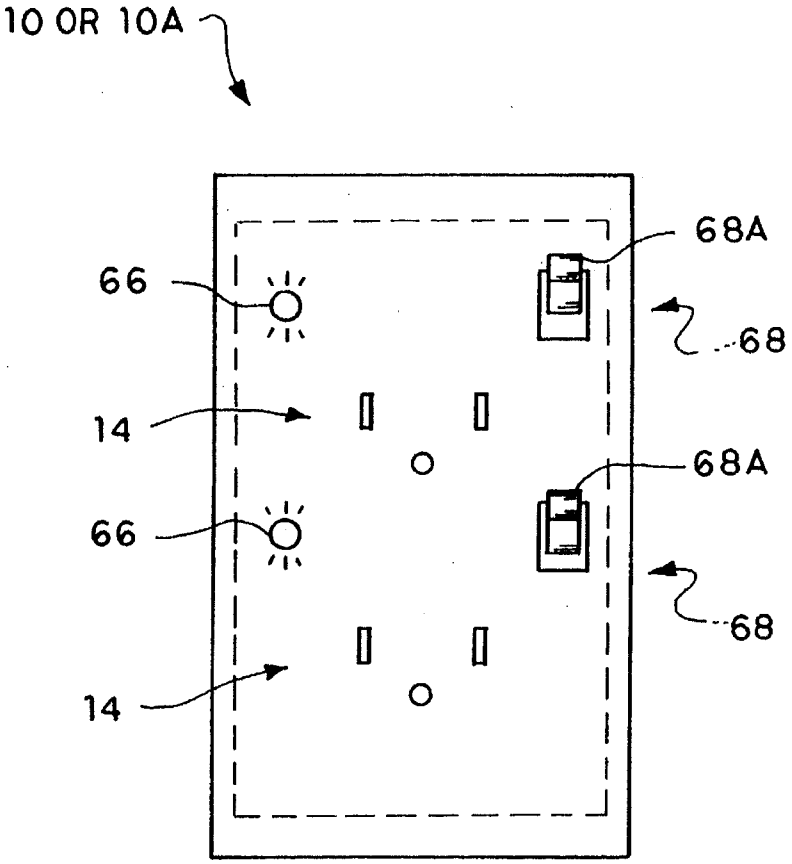
FIG. 4 is a front elevational, diagrammatic view showing indication and reset devices.

In a preferred embodiment, and again referring to FIG. 2, safety device 10 includes an interlocking arrangement maintaining the relay having normally closed contacts 26 in the energized state. This will prevent a potentially repeating cycle of operating and interrupting operation of an appliance (not shown). Turning to FIG. 4, there is also an indicator 66, provided by an indicating lamp, indicating the alarm condition. A switch 68, having an operating toggle 68A, is provided to enable a user to reset contacts 26 (see FIG. 2).

Figure 3:
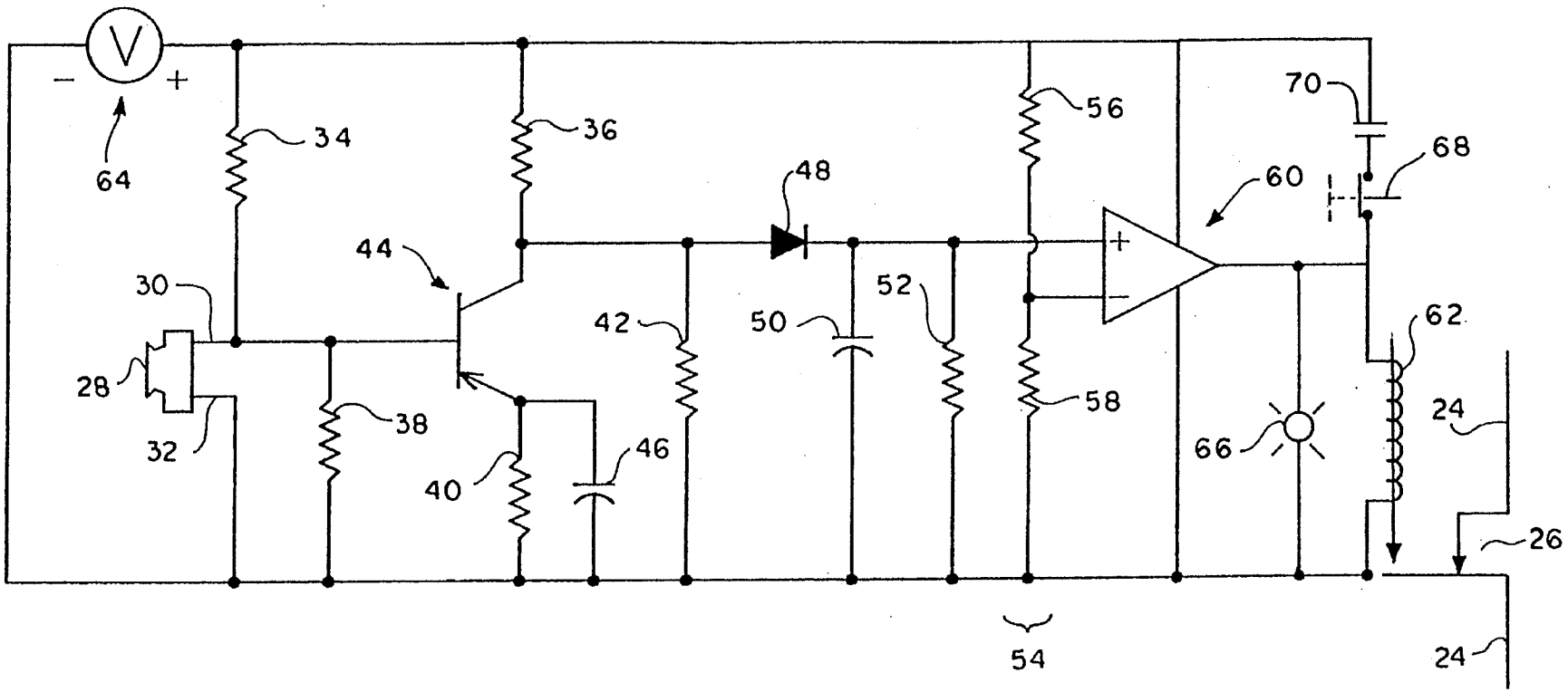
FIG. 3 is an electrical schematic of control circuitry of the invention.

Operation of indicator 66 and switch 68 is explained with reference to FIG. 3. With toggle 68A spring biased in the closed position, continuity is provided between normally open holding contacts 70 and coil 62. When the alarm condition causes coil 62 to be energized, contacts 70 close, holding the associated relay in the energized state. Indicator 66, which comprises a lamp connected in parallel with coil 62, indicates breakage of power to the receptacle portion of device 10.

After the alarm condition is no longer detected, the circuit leg including contacts 70 is the only source of power to coil 62 and indicator 66. Switch 68 momentarily breaks this power, so that coil 62 is deenergized, and the relay resets.

Figure 5:
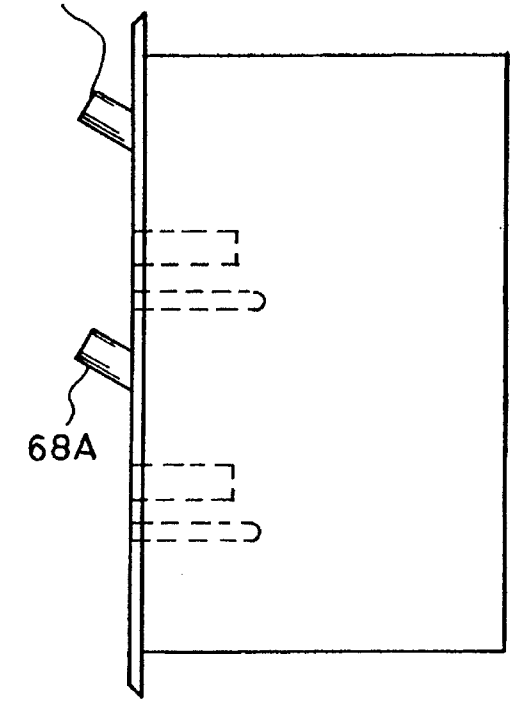
FIG. 5 is a diagrammatic, side elevational view illustrating an embodiment of the invention incorporating an integral electrical receptacle.

In a second embodiment, illustrated in FIG. 5, safety device 10A is directly wired to the building wiring system in the same manner as a standard electrical receptacle is connected. Such connection would encompass both power and grounded conductors, where the latter is required or routinely furnished. In this form, safety device 10A is incorporated into the building, and supplants the separate safety device 10 and receptacle 2. Operation of the second embodiment safety device 10A is the same as that of separate safety device 10, except that there is no separate component to be plugged into receptacle 2.

The control scheme presented above is merely one possible embodiment. It will occur to those of ordinary skill in the art to modify this control scheme to perform in different ways. For example, it is possible to select values of the components of this control scheme, and to incorporate further features, so as to cause the novel safety device to be responsive to a desired band of sonic frequencies, so that it responds to an audible alarm of selected sonic characteristics. In a similar vein, the interlocking arrangement and indicator may take still other forms, while providing identical functions. It is to be understood that the present invention is not limited to the embodiments described above, but encompasses any and all embodiments within the scope of the following claims.

I claim:

1. An electrical safety disconnecting device having a standard electrical receptacle for receiving the plug of an appliance power cord and conducting electrical power from a building wiring system, said device for selectively and automatically discontinuing power to said receptacle, said device comprising:

a power circuit including electrical conductors connectable to the building wiring system, at least one protected receptacle connected in series with the building wiring system;

an automatic switch selectively tripping, wherein said automatic switch breaks electrical continuity to said protected receptacle; and and means for detecting an audible alarm and operating said automatic switch responsive thereto.

2. The device according to claim 1, said power circuit having protruding electrical conductor members cooperating with and attachable to a preexisting receptacle, whereby said device is plugged into the preexisting receptacle for support and for connection to electrical power.

3. The device according to claim 2, said protected receptacle corresponding in configuration to a preexisting receptacle.

4. The device according to claim 3, wherein the preexisting receptacle is a duplex receptacle, and said protected receptacle is a duplex receptacle.

5. The device according to claim 1, further including an uninterrupted conductor connectable to grounded conductors in the building wiring system and to the appliance plugs.

6. The device according to claim 5, wherein the building wiring system includes a preexisting duplex receptacle, each individual receptacle thereof having a grounded conductor, said protected receptacle comprising a duplex receptacle including at least one grounded conductor configured and dimensioned to interfit with the grounded conductors of the preexisting duplex receptacle.

7. The device according to claim 1, further comprising an indicator indicating a tripped condition wherein power to said protected receptacle is discontinued.

8. The device according to claim 1, further comprising means for maintaining said device in a tripped condition, wherein power is discontinued, and means for manually restoring power.

9. The device according to claim 1, further comprising:

an indicator indicating the tripped condition, wherein power to said protected receptacle is discontinued;

means for maintaining power discontinued, and for maintaining said indicator operative; and means for manually restoring power and for discontinuing indication by said indicator of the tripped condition.

10. An electrical safety disconnecting device for discontinuing power to an appliance cord plugged into a preexisting, standard electrical receptacle, said device comprising:

a power circuit including electrical conductors connectable to the power conductors of the preexisting receptacle, at least one protected receptacle corresponding in configuration to the preexisting receptacle and connected in series with said electrical conductors, said power circuit having protruding electrical conductor members cooperating with and attachable to the preexisting receptacle, whereby said device is plugged into the existing receptacle for support and for connection to electrical power;

an automatic switch selectively breaking electrical continuity of at least one of said electrical conductors; and and means for detecting an audible alarm and operating said automatic switch responsive thereto.

11. The device according to claim 10, further including an uninterrupted conductor connectable to grounded conductors in the preexisting receptacle and appliance plugs.

12. The device according to claim 11, wherein the preexisting receptacle is a duplex receptacle, and said protected receptacle is a duplex receptacle.

13. The device according to claim 10, further comprising an indicator indicating the condition wherein power to said protected receptacle is discontinued.

14. The device according to claim 10, further comprising means for maintaining power discontinued, and means for manually restoring power.

15. An electrical safety disconnecting device having a standard electrical receptacle for receiving the plug of an appliance power cord and conducting electrical power from a building wiring system, said device for selectively and automatically discontinuing power to said receptacle, said device comprising:

a power circuit including electrical conductors connectable to the building wiring system, at least one protected receptacle connected in series with the building wiring system;

an automatic switch selectively tripping, wherein said automatic switch breaks electrical continuity to said protected receptacle;

means for detecting an audible alarm and operating said automatic switch responsive thereto;

an indicator indicating a tripped condition wherein power to said protected receptacle is discontinued;

an indicator indicating the tripped condition, wherein power to said protected receptacle is discontinued;

means for maintaining power discontinued, and for maintaining said indicator operative; and means for manually restoring power and for discontinuing indication by said indicator of the tripped condition.

16. The device according to claim 15, further including an uninterrupted conductor connectable to grounded conductors in the building wiring system and to an appliance plug.

* * * * *